US010109165B2

(12) United States Patent
Han et al.

(10) Patent No.: US 10,109,165 B2
(45) Date of Patent: Oct. 23, 2018

(54) NOTIFICATION DEVICE

(71) Applicant: Siemens Schweiz AG, Zurich (CH)

(72) Inventors: Guo Liang Han, Beijing (CN); Shao Chen Lin, Beijing (CN); Li Ren, Beijing (CN)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 15/547,717

(22) PCT Filed: Jan. 15, 2016

(86) PCT No.: PCT/EP2016/050748
§ 371 (c)(1),
(2) Date: Jul. 31, 2017

(87) PCT Pub. No.: WO2016/120096
PCT Pub. Date: Aug. 4, 2016

(65) Prior Publication Data

US 2018/0025594 A1 Jan. 25, 2018

(30) Foreign Application Priority Data

Jan. 29, 2015 (CN) ..... 2015 2 0066138 U

(51) Int. Cl.
*G08B 17/00* (2006.01)
*G08B 7/06* (2006.01)

(52) U.S. Cl.
CPC ..... *G08B 7/06* (2013.01); *G08B 17/00* (2013.01)

(58) Field of Classification Search
CPC ..... G08B 7/06
(Continued)

(56) References Cited

U.S. PATENT DOCUMENTS 5,877,695 A * 3/1999 Kubes ..... G08B 3/1058 340/815.4
6,906,616 B1 6/2005 Curran et al. ..... 340/293
(Continued)

FOREIGN PATENT DOCUMENTS

WO 2016/120096 A1 8/2016 ..... G08B 17/00

OTHER PUBLICATIONS

International Search Report and Written Opinion, Application No. PCT/EP2016/050748, 13 pages, dated Apr. 14, 2016.

*Primary Examiner* — Qutbuddin Ghulamali
(74) *Attorney, Agent, or Firm* — Slayden Grubert Beard PLLC

(57) ABSTRACT

The present disclosure relates to notification devices. The teachings thereof may be embodied in methods and devices for providing an alarm signal, e.g., a notification device having multiple different alarm strengths comprising: a housing with a viewing opening; an alarm component which emits an alarm signal; a drive circuit comprising a drive end and a setting end, the drive end connected to the alarm component; and a replaceable jump wire assembly comprising a mark and a conductive element with a one-to-one correspondence between the mark and an electrical characteristic of the conductive element. The drive circuit may determine an alarm signal strength in response to an input of the setting end. Each replaceable jump wire assembly may be connected to the setting end of the drive circuit and, when connected, display the mark for viewing through the viewing opening.

10 Claims, 5 Drawing Sheets

(58) Field of Classification Search
USPC ..... 340/691.8
See application file for complete search history.

(56) References Cited

U.S. PATENT DOCUMENTS

| | | | | |
|---|---|---|---|---|
| 2004/0056773 | A1* | 3/2004 | Zimmerman | G08B 5/38 340/815.4 |
| 2013/0335229 | A1* | 12/2013 | Savage, Jr. | G08B 5/38 340/577 |
| 2017/0092083 | A1* | 3/2017 | Lin | F21V 5/04 |

* cited by examiner

NOTIFICATION DEVICE

CROSS-REFERENCE TO RELATED APPLICATIONS

This application is a U.S. National Stage Application of International Application No. PCT/EP2016/050748 filed Jan. 15, 2016, which designates the United States of America, and claims priority to CN Application No. 201520066138.1 filed Jan. 29, 2015, the contents of which are hereby incorporated by reference in their entirety.

TECHNICAL FIELD

The present disclosure relates to notification devices. The teachings thereof may be embodied in methods and devices for providing an alarm signal, e.g., a notification device having multiple different alarm strengths.

BACKGROUND

Notification devices (for example acoustic alarm devices and/or optical alarm devices) are generally placed in buildings, for the purpose of emitting an auditory, visual, and/or text alarm signal when a potential danger is discovered, e.g. when a fire or emergency occurs. These devices are designed to attract the attention of people at the scene and encourage these people to evacuate or take other necessary action.

A typical optical alarm device used for warning of fire comprises a light-emitting component used as a warning, such as a xenon lamp or a light-emitting diode (LED), and a drive circuit capable of lighting the light-emitting component once power is supplied. The optical alarm device is connected to a central control device, e.g., via a field wire or field bus. Upon determining an alarm is to be issued, the central control device instructs the drive circuit via the field wire to begin operating, so as to light the light-emitting component, e.g., emit an optical alarm signal.

SUMMARY

Teachings of the present disclosure may provide a notification device capable of conveniently setting the current alarm signal strength of the notification device. Such devices may provide a notification device which is also compatible with two operating modes, manual setting and automatic addressing setting.

For example, a notification device (10) may comprise: a housing (120) on which a viewing opening (124) is provided; at least one alarm component (140) which emits an alarm signal in the form of sound or in a visual form; a drive circuit (160) positioned in the housing (120), the drive circuit (160) comprising a drive end (165) and a setting end (167), the drive end (165) being connected to the alarm component and the drive circuit (160) being configured to determine an alarm signal strength of the alarm component in response to an input of the setting end; and at least one replaceable jump wire assembly (180, 580), comprising a mark (181, 581) and a conductive element (186), with a one-to-one correspondence between the mark and an electrical characteristic of the conductive element, wherein each said jump wire assembly (180) is suitable for being connected to the setting end (167) of the drive circuit (160), and in a connected state, the mark (182) can be viewed through the viewing opening (124).

In some embodiments, the jump wire assembly (180) comprises multiple replaceable first jump wire assemblies, the conductive elements in the multiple first jump wire assemblies have different electrical properties, each mark (181) thereof is set to indicate one of multiple different alarm signal strengths, and in the case where one of the multiple first jump wire assemblies (180) is connected to the setting end (167) of the drive circuit (160), the strength of the alarm signal driven by the drive circuit is consistent with the mark.

In some embodiments, the jump wire assembly (580) comprises a replaceable second jump wire assembly, a mark (A) thereof being configured to indicate an addressable mode, and an electrical characteristic of a conductive element thereof being different from the first jump wire assembly; and the drive circuit (560) also comprises a circuit input end (163) connectable to a field circuit, and in the case where the second jump wire assembly (580) is connected to the setting end (167) of the drive circuit (560), the drive circuit (560) determines an alarm signal strength according to a signal from the circuit input end (163) in response to an input of the setting end (167) of the drive circuit.

In some embodiments, the housing also comprises an indication opening (590); and the notification device also comprises an indication component (592), which is connected to the drive circuit (560) and arranged so as to be viewable through the indication opening (590), and used for indicating a currently set alarm signal strength.

In some embodiments, the conductive element in each jump wire assembly is a resistive element or a capacitive element.

In some embodiments, each jump wire assembly comprises: an assembly casing (184) suitable for accommodating the conductive element (186); a top cover (182) with the mark (181, 581), the top cover being fastened to the assembly casing; an insert-pin part (188), projecting from the assembly casing and suitable for being connected to two ends of the conductive element positioned in the assembly casing, and the insert-pin part also being suitable for being inserted in the setting end (167) of the drive circuit (160).

In some embodiments, the conductive element and the top cover are replaceable.

In some embodiments, there are multiple spare part holders, which are disposed in the housing and suitable for accommodating multiple said jump wire assemblies, and the multiple spare part holders are formed of ribs formed integrally with the housing.

In some embodiments, the alarm component is a light-emitting component or a sound-emitting component.

In some embodiments, the notification device is a fire alarm device.

BRIEF DESCRIPTION OF THE DRAWINGS

Example embodiments are explained below in conjunction with the accompanying drawings, in a clear and easy to understand manner, to further explain the above characteristics, technical features, and advantages along with methods of implementation thereof. The accompanying drawings below merely illustrate and explain the present disclosure schematically, without defining the scope thereof.

DETAILED DESCRIPTION

Figure 1:
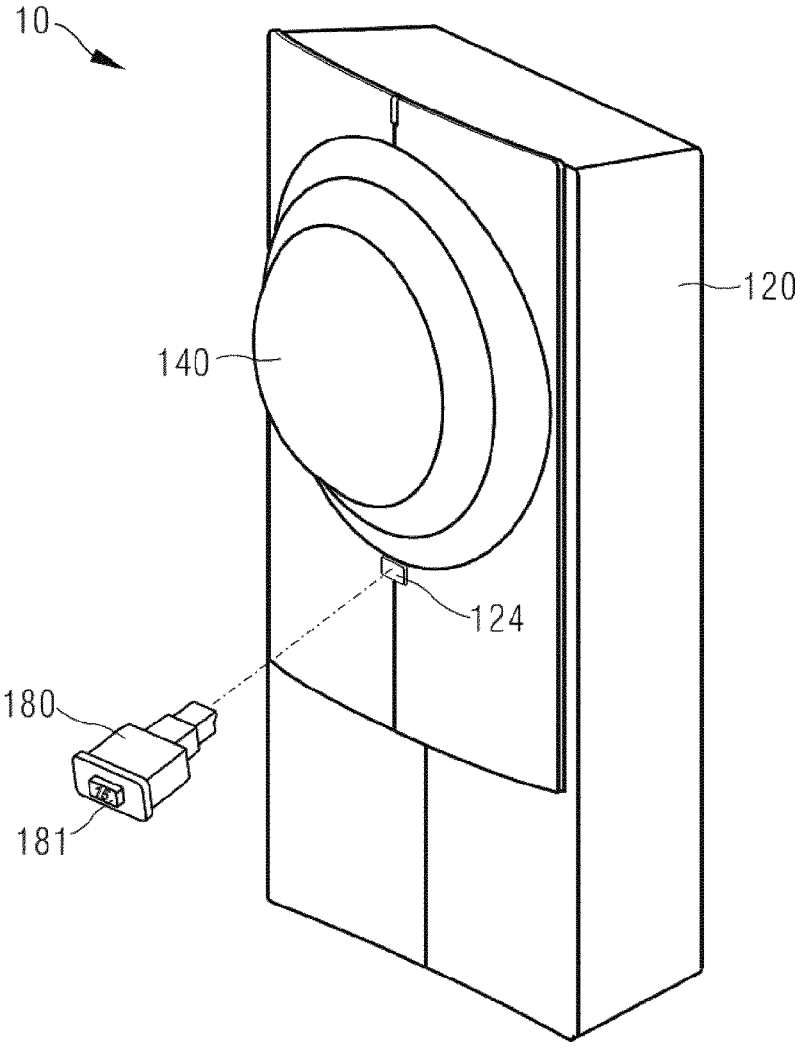
FIG. 1 shows a structural diagram of an optical alarm device according to teachings of the present disclosure.

Due to safety considerations, each country regulates notification devices according to its own mandatory standards. These standards specify performance indices and requirements for different aspects of notification devices. For example, taking into account differences in notification device installation environments, certain standards demand that the alarm signal strength of a notification device must be somewhat different in different installation environments or positions. To satisfy this standard demand, a notification device must be able to provide alarm signals of different alarm strengths. For example, in the case of optical alarm devices, US standards specify that an optical alarm device must be able to provide at least four different illumination strengths (in units of Candela), namely 15 Candela, 30 Candela, 75 Candela and 110 Candela. Furthermore, standards also demand that once an optical alarm device has been installed, the current illumination strength thereof is easily observable, e.g. marked thereon in a way which prevents illegal alteration.

Many different ways of indicating different illumination strengths of an optical alarm device have been proposed in the prior art. For example, an optical alarm device may include a slideable selection switch, and an indication table marked with different illumination strengths. The selection switch can be set to different positions, so as to select one of the multiple different illumination strengths. When set to a particular position, the selection switch indicates an illumination strength corresponding to that position. Since the selection switch is positioned inside the optical alarm device, such an arrangement can satisfy the relevant requirements of the standards. However, a slideable selection switch is generally assembled from multiple different components, so the processing steps and installation requirements thereof are relatively complex.

In some embodiments of the present teachings, an example notification device comprises: a housing with a viewing opening; at least one alarm component emitting an alarm signal in the form of sound or in a visual form; a drive circuit in the housing, comprising a drive end connected to the alarm component and a setting end. The drive circuit may determine an alarm signal strength of the alarm component in response to an input of the setting end. The device may include at least one replaceable jump wire assembly comprising a mark and a conductive element, with a one-to-one correspondence between the mark and an electrical characteristic of the conductive element, wherein each said jump wire assembly is suitable for being inserted in the setting end of the drive circuit, and in an inserted state, the mark can be viewed through the viewing opening.

In some embodiments, the conductive element is a resistor or a capacitor. Latter one is particularly conductive for alternating voltages across the capacitor. In some embodiments, the alarm component is a light-emitting component or a sound-emitting component. In some embodiments, the notification device is a fire alarm device. Alternatively, the conductive element is an inductor.

Using such a notification device, a user can conveniently set the alarm strength of the notification device by means of the jump wire assembly. The jump wire assembly has a simple structure and is easy to implement, thus the notification device does not require complex processing steps.

In some embodiments, the jump wire assembly comprises multiple replaceable first jump wire assemblies, the conductive elements in the multiple first jump wire assemblies have different electrical properties, e.g., different resistance values or capacitance values, (values in ohms or farads). Each mark thereof indicates one of multiple different alarm signal strengths, and in the case where one of the multiple first jump wire assemblies is inserted into the setting end of the drive circuit, the strength of the alarm signal driven by the drive circuit is consistent with the mark. Using such a notification device, a user can conveniently set the current alarm signal strength of the notification device manually by replacing the jump wire assembly; the setting method is simple and convenient, and the setting is indicated clearly.

In some embodiments, the jump wire assembly comprises a replaceable second jump wire assembly. A mark on the assembly may indicate an addressable mode. An electrical characteristic of a conductive element thereof may be different from the first jump wire assembly. The drive circuit may comprise a circuit input end connectable to a field circuit, and in the case where the second jump wire assembly is inserted in the setting end of the drive circuit, the drive circuit determines an alarm signal strength according to a signal from the circuit input end in response to an input of the setting end of the drive circuit. Using such a notification device, a user can set an addressable mode of the notification device by replacing the jump wire assembly, to determine an alarm signal strength according to a signal from the circuit input end. Thus, the problem of compatibility between the manual setting mode and the addressable mode is solved conveniently by means of the jump wire assembly.

In some embodiments, the housing also comprises an indication opening. The notification device comprises an indication component connected to the drive circuit and viewable through the indication opening. The indication component may indicate a currently set alarm signal strength.

In some embodiments, each jump wire assembly comprises: an assembly casing suitable for accommodating the conductive element; a top cover with the mark, fastened to the assembly casing; an insert-pin part projecting from the assembly casing and connected to two ends of the conductive element positioned in the assembly casing and inserted in the setting end of the drive circuit. In some embodiments, the conductive element and the top cover are replaceable. In some embodiments, the notification device also comprises multiple spare part holders disposed in the housing and suitable for accommodating multiple said jump wire assemblies, and the multiple spare part holders are formed of ribs formed integrally with the housing. Using such a jump wire assembly structure, the conductive element can gain full protection and isolation. When necessary, all that is needed is to replace the conductive element and the corresponding mark. Thus, replacement is convenient, and the space for storing spare parts can be smaller. The design of the spare part holders makes it easier for the user to select a suitable jump wire assembly to perform setting according to actual requirements. Furthermore, the replaceable jump wire assembly is not easily lost.

In the accompanying drawings, identical labels indicate components with the same structure or components with similar structures but the same function. To make the drawings appear uncluttered, only those parts relevant to the present invention are shown schematically in the drawings; they do not represent the actual structure thereof as a product. Furthermore, to make the drawings appear uncluttered for ease of understanding, in the case of components having the same structure or function in certain drawings, only one of these is drawn schematically, or only one is marked.

In this text, "a" does not only mean "just this one", but may also mean the case of "more than one". Furthermore, in this text, "first", "second", etc. are merely used for distinguishing one component from another, and do not indicate the degree of importance or order, etc. thereof.

FIG. 1 shows the overall structure of an example optical alarm device 10. As FIG. 1 shows, the optical alarm device 10 comprises a housing 120 and an alarm component 140. In the example shown in FIG. 1, the alarm component 140 includes a light-emitting component, e.g., a xenon lamp or a light-emitting diode (LED). The light-emitting component 140 is at least partly within the housing 120. Part of the light-emitting component 140 can project from the housing 120, to produce desired levels of illumination.

The optical alarm device 10 comprises a replaceable jump wire assembly 180. The jump wire assembly 180 may be within the housing 120. When the jump wire assembly 180 is within the housing 120, a mark 181 (e.g., mark "15" in FIG. 1) at an end of the jump wire assembly 180 can be viewed through a viewing opening 124 on the housing 120. The mark at the end of the jump wire assembly 180 may, for example, indicate that the current alarm signal strength of the optical alarm device is one of multiple different alarm signal strengths.

Figure 2:
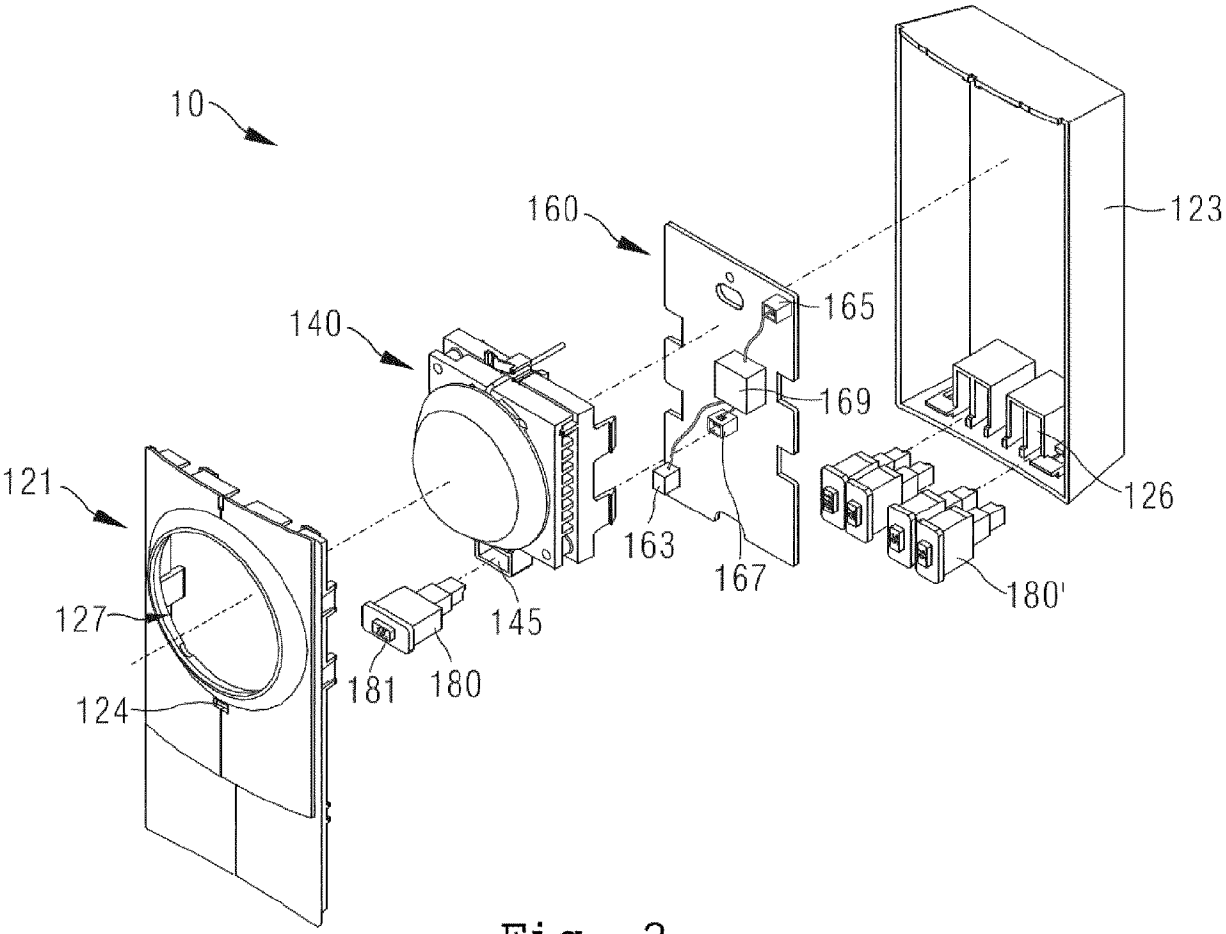
FIG. 2 shows an assembly diagram of an optical alarm device according to teachings of the present disclosure.

FIG. 2 shows an example structure of an example optical alarm device 10. As FIG. 2 shows, the housing 120 of the optical alarm device 10 may comprise a front cover 121 and a rear cover 123. The front and rear covers 121 and 123 of the housing 120 can be fastened together. A viewing opening 124 is provided on the front cover 121. The viewing opening may also be disposed on a sidewall of the rear cover 123, in a position that can be viewed by an observer. According to actual needs, the viewing opening 124 may also be disposed in another position suitable for viewing by an observer.

As shown in FIG. 2, the optical alarm device 10 comprises a light-emitting component 140 and a drive circuit 160 for lighting the light-emitting component 140. Optionally, a window 127 may also be provided on the front cover 121. When the light-emitting component 140 is installed in the housing 120, an optical structure part thereof (e.g. a lens covering an LED) may project from the window 127. The drive circuit 160 is positioned in the housing 120; specifically, the drive circuit is for example installed in the rear cover 123 and fixed to the rear cover 123 by fastening elements such as screws or engagement hooks. In the example of FIG. 2, the light-emitting component 140 is fixed to the drive circuit 160 by engagement connection (e.g. engagement hooks). Optionally, the light-emitting component 140 may be fixed to the front cover and connected to the drive circuit 160 by an electronic circuit. Alternatively, the light-emitting component 140 may be fixed to the rear cover in alignment with the drive circuit 160 by means of a locating element or a locating hole.

In FIG. 2, the drive circuit 160 comprises a drive end 165 and a setting end 167. Optionally, the drive circuit 160 may also comprise a circuit input end 163 connected to a field circuit and obtain an instruction signal from the field circuit. The drive end 165 may be connected to the light-emitting component 140 to light the light-emitting component 140. The setting end 167 may be suitable for one end of the jump wire assembly 180 to be inserted therein, and thereby obtains a corresponding setting input. In FIG. 2, the remaining circuit of the drive circuit 160 has been simplified to a device 169 in the figure, which device may comprise an integrated circuit chip, discrete electronic elements, a logic circuit, etc. on the drive circuit.

In FIG. 2, one end of the jump wire assembly 180 has a mark 181, while another end is suitable for being inserted in the setting end 167 on the drive circuit 160. As FIG. 2 shows, the jump wire assembly 180 may be a replaceable component. In the rear cover 123 are multiple spare part holders 126, which can be used to accommodate various spare jump wire assemblies 180' for substitution; the marks on these jump wire assemblies may be different from one another. Each mark indicates one of multiple different alarm signal strengths. For example, as FIG. 2 shows, the marks may include 15, 35, 75, and 110. The spare part holders in FIG. 2 may include ribs formed integrally with the housing. Optionally, the spare part holders may also be used to store conductive elements for substitution.

In some embodiments, the optical alarm device 10 may include a clamp 145 for holding the jump wire assembly 180 at a predetermined position. The predetermined position is such that once the jump wire assembly 180 is installed, the mark 181 at one end thereof can be viewed through the viewing opening 124, while the other end thereof can be reliably connected to the setting end 167 of the drive circuit 160. In FIG. 2, the clamp 145 includes a rectangular sleeve connected to the light-emitting component 140 and the jump wire assembly 180 can pass through the sleeve and be held in a position aligned with the center of the viewing opening. The use of the clamp 145 can reinforce the steady supporting of the jump wire assembly 180.

In FIG. 2, if it is determined that an alarm needs to be issued, a central control device (e.g., control panel) (not shown) can provide electrical energy and/or an alarm instruction to each optical alarm device via a field circuit. The circuit input end 163 of the drive circuit 160 may receive an activation instruction from the field circuit, so that the entire drive circuit 160 is activated. Then, in response to a setting input obtained from the setting end 167 through the jump wire assembly 180, the drive circuit 160 determines an alarm signal strength corresponding to the mark 181 of the inserted jump wire assembly 180. In the example of FIG. 2, the mark of the jump wire assembly inserted in the setting end 167 is "15", so the drive circuit for example selects 15 Candela from multiple different illumination strengths (e.g., 110, 75, 35, or 15 Candela), and sets this as the current alarm signal strength. The drive circuit 160 may set the alarm signal strength by means of a selection circuit, etc.

Figure 3:
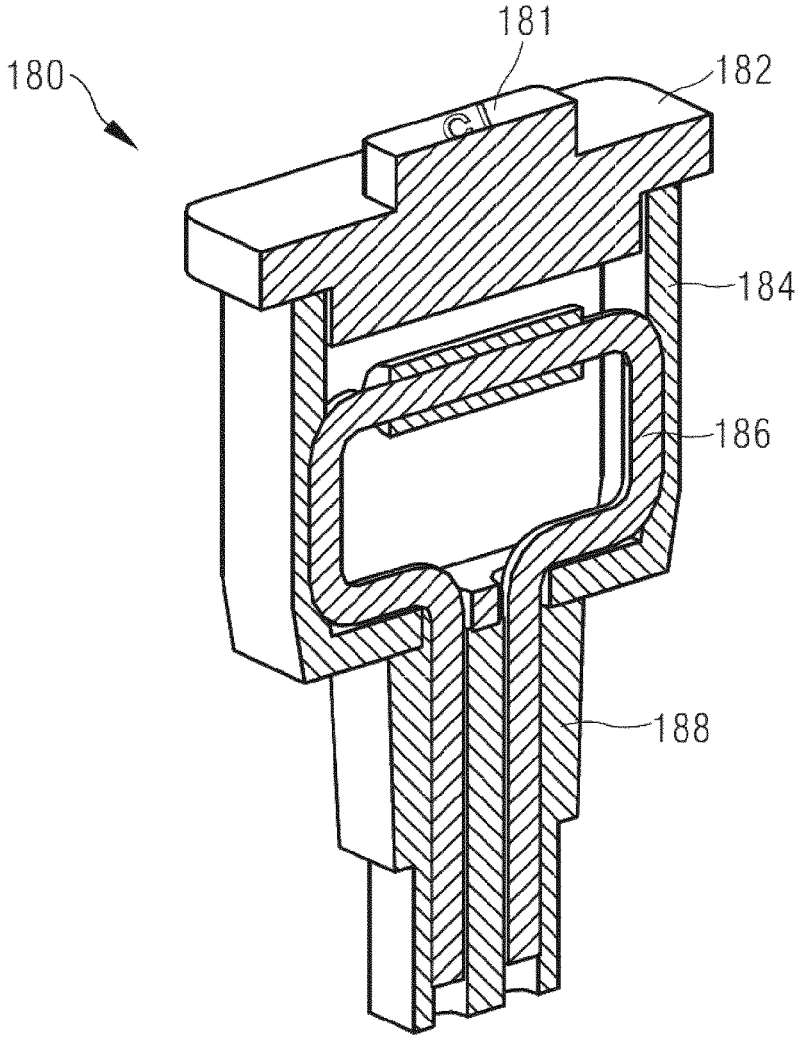
FIG. 3 shows a sectional drawing of a jump wire assembly in an optical alarm device according to teachings of the present disclosure.
Figure 4:
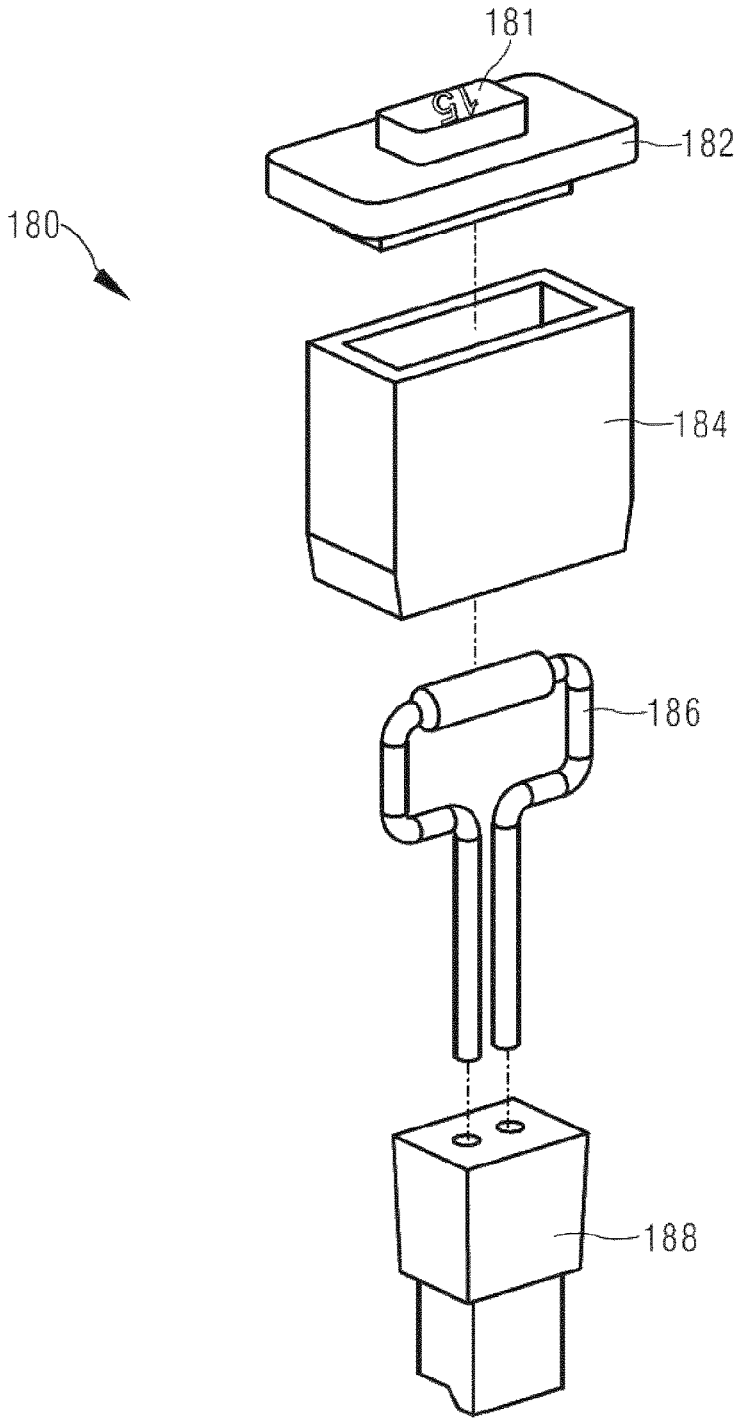
FIG. 4 shows an assembly diagram of a jump wire assembly in an optical alarm device according to teachings of the present disclosure.

FIG. 3 shows an example jump wire assembly 180 according to some embodiments. FIG. 4 shows an exploded view of the jump wire assembly 180 in FIG. 3. In the example shown in FIGS. 3 and 4, the jump wire assembly 180 comprises a top cover 182, an assembly casing 184, a conductive element 186 positioned in the assembly casing, and an insert-pin part 188. As FIG. 3 shows, the conductive element 186 may accommodated in the assembly casing 184. An upper part of the assembly casing 184 may be covered by a top cover 182, with the mark 181 being positioned on the top cover 182.

In some embodiments, there is a one-to-one correspondence between the mark 181 and an electrical property (e.g. the magnitude of the resistance or capacitance) of the conductive element 186. Different jump wire assemblies may have different marks 181 and the electrical properties of the conductive elements 186 corresponding thereto are also different. For example, in FIGS. 3 and 4, the conductive element 186 is a resistive element, so the resistive elements in different jump wire assemblies have different resistance values to differentiate different warning signal strengths (e.g. illumination strengths). In some embodiments, the conductive element 186 may include a capacitive element. In jump wire assemblies under different marks, the magnitudes of capacitance of the capacitive elements are correspondingly different. Pins at a lower part of the conductive element 186 can be inserted into the insert-pin part 188.

When the jump wire assembly 180 is inserted into the setting end 167 on the drive circuit 160, the insert-pin part 188 is inserted into the setting end 167. In some embodiments, the setting end 167 can be connected to a setting input circuit. The input circuit can convert the electrical property of the conductive element 186 inserted in the setting end 167 to a current or voltage signal. For example, the input circuit may be a resistance potentiometer circuit or a circuit which charges a capacitor with a steady current. In response to the input of the setting end 167 (e.g. current or voltage), the drive circuit 160 determines an alarm optical signal strength corresponding to the mark on the jump wire assembly, e.g. 15 Candela.

The jump wire assembly shown in FIGS. 3 and 4 may also be replaced by another form of jump wire assembly. For example, the jump wire assembly may only comprise either a resistor or a capacitor, the color of which varies, with no need for a top cover, assembly casing, or insert-pin part. The color of the resistor or capacitor itself can then be used as a mark, to differentiate different alarm signal strengths. In some embodiments, the assembly casing and insert-pin part may also be omitted from the jump wire assembly. Optionally, when replacing the jump wire assembly, it is possible for only the conductive element and the top cover with the mark to be replaced.

Figure 5:
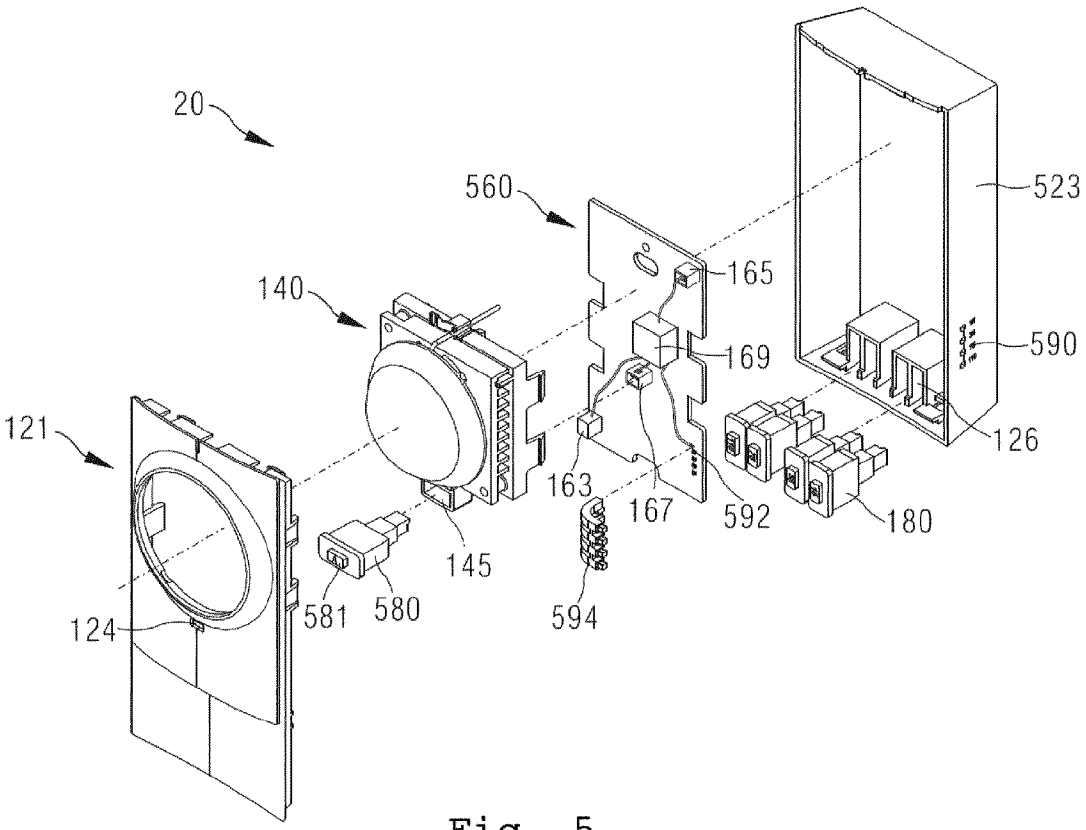
FIG. 5 shows an assembly diagram of an optical alarm device according to teachings of the present disclosure/

FIG. 5 shows by way of example an optical alarm device 20 according to another embodiment. Similarly to the situation shown in FIG. 2, the optical alarm device 20 comprises a front cover 121, a rear cover 523, a light-emitting component 140, a drive circuit 560 and a jump wire assembly 580. The light-emitting component 140 can be connected to a drive end 165 on the drive circuit 560 and driven by the drive end 165. The jump wire assembly 580 can be inserted into the setting end 167 on the drive circuit 560 and, after insertion, a mark 581 on the jump wire assembly 580 can be viewed through a viewing window 124 on the front cover 121. The various jump wire assemblies 180 shown in FIG. 2 for indicating alarm signal strengths can be positioned in spare part holders 126. Components in FIG. 5 which are the same as in FIG. 2 are indicated using the same reference labels, and have the same or similar functions or structures, which will not be repeated here.

Unlike FIG. 2, in the optical alarm device 20 shown in FIG. 5, the mark 581 on the top cover of the jump wire assembly 580 is an exemplary addressing mode indication "A", which indicates that the current optical alarm device 20 has been set to an addressable mode. Correspondingly, the conductive elements (not shown in FIG. 5) of the jump wire assembly 580 and jump wire assembly 180 also have different electrical characteristics. Once the jump wire assembly 580 has been inserted into the setting end 167, the drive circuit 560 can determine that the current mode is the addressable mode according to the input of the setting end 167, and the alarm signal strength is determined by an input signal from a circuit input end 163. Thus, the drive circuit 560 determines an alarm optical strength according to a signal received by the circuit input end 163, e.g., determines one of 110, 75, 35, or 15 as the current alarm optical strength.

In some embodiments, an indication component 592 is also disposed on the drive circuit 560, for indicating the current alarm signal strength. In the example of FIG. 5, the indication component 592 may include four light-emitting diodes, each light-emitting diode corresponding to one illumination strength selected from 110, 75, 35, and 15. In some embodiments, an opening or transparent part may be provided on the front cover 121 so that the indication component 592 is visible to an observer. In the example of FIG. 5, four indication openings 590 are provided on a side of the rear cover 523 with corresponding illumination strengths being marked on one side of the indication openings.

In some embodiments, a light guide 594 with a 90-degree bend is disposed in a position corresponding to the indication openings 590. The light guide may guide light emitted by the indication component 592, which is arranged facing the front cover 121, to a direction facing the indication openings 590 on the side of the rear cover 523. In some embodiments, the indication component 592 may also be an LED lamp capable of displaying four different colors for example.

The examples above may also be used for setting a sound alarm strength of a sound-emitting component of an acoustic alarm device or a strength of sound and illumination in an acoustic/optical alarm device. In the case of an acoustic alarm, the alarm signal strength is the magnitude of the sound pressure level, while the other arrangements are the same as in the optical alarm device above. In the case of an acoustic/optical alarm device, the setting of the alarm signal strength can be suitable for sound signals and light signals separately, and sound and light may be set jointly according to the actual situation.

What is claimed is:

1. A notification device comprising:

a housing with a viewing opening;

an alarm component which emits an alarm signal;

a drive circuit disposed in the housing, the drive circuit comprising a drive end and a setting end, the drive end connected to the alarm component;

and a replaceable jump wire assembly comprising a mark and a conductive element with a one-to-one correspondence between the mark and an electrical characteristic of the conductive element;

wherein the replaceable jump wire assembly may be connected to the setting end of the drive circuit and, when connected, display the mark for viewing through the viewing opening;

wherein drive circuit determines an alarm signal strength of the alarm component based on the electrical characteristic of the conductive element in the replaceable jump wire assembly.

2. The notification device as claimed in claim 1, further comprising multiple replaceable jump wire assemblies wherein the respective conductive elements in the multiple jump wire assemblies each have distinct electrical properties; and wherein each mark indicates one of multiple different alarm signal strengths; and the strength of the alarm signal driven by the drive circuit is consistent with the mark of the one of different alarm signal strengths when the respective jump wire assembly is connected to the setting end of the drive circuit.

3. The notification device as claimed in claim 2, wherein a second jump wire assembly includes a mark indicating an addressable mode;

an electrical characteristic of a conductive element associated with the second jump wire assembly is different from the first jump wire assembly; and the drive circuit comprises a circuit input end connectable to a field circuit; and in the case where the second jump wire assembly is connected to the setting end of the drive circuit, the drive circuit determines an alarm signal strength according to a signal from the circuit input end in response to an input of the setting end of the drive circuit.

4. The notification device as claimed in claim 1, wherein the housing comprises an indication opening; and the notification device comprises an indicator connected to the drive circuit to be viewable through the indication opening, and used for indicating a currently set alarm signal strength.

5. The notification device as claimed in claim 1, wherein the conductive element in each jump wire assembly includes a resistive element or a capacitive element.

6. The notification device as claimed in claim 1, wherein each jump wire assembly comprises:

an assembly casing for accommodating the conductive element;

a top cover fastened to the assembly casing; and an insert-pin part projecting from the assembly casing and suitable for being connected to two ends of the conductive element positioned in the assembly casing;

wherein the insert-pin part may be inserted in the setting end of the drive circuit.

7. The notification device as claimed in claim 6, wherein the conductive element and the top cover are replaceable.

8. The notification device as claimed in claim 6, further comprising multiple spare part holders disposed in the housing and accommodating multiple said jump wire assemblies; and wherein the multiple spare part holders comprise ribs formed integrally with the housing.

9. The notification device as claimed in claim 1, wherein the alarm component comprises a light-emitting component or a sound-emitting component.

10. The notification device as claimed in claim 1, wherein the notification device comprises a fire alarm device.

* * * * *